US005352650A

United States Patent [19]

Minami et al.

[11] Patent Number: 5,352,650

[45] Date of Patent: Oct. 4, 1994

[54] THERMAL RECORDING SHEET

[75] Inventors: Toshiaki Minami; Toshio Kaneko, both of Tokyo, Japan

[73] Assignee: Jujo Paper Co., Ltd., Tokyo, Japan

[21] Appl. No.: 32,026

[22] Filed: Mar. 16, 1993

[30] Foreign Application Priority Data

Mar. 18, 1992 [JP] Japan ..... 4-62001

[51] Int. Cl.[5] ..... B41M 5/28

[52] U.S. Cl. ..... 503/209; 503/216; 503/217; 503/218; 503/225; 503/226

[58] Field of Search ..... 503/209, 216, 225, 226, 503/217, 218

[56] References Cited

U.S. PATENT DOCUMENTS 4,644,375 2/1987 Satake et al. ..... 503/216

*Primary Examiner*—Pamela R. Schwartz

*Attorney, Agent, or Firm*—Sherman and Shalloway

[57] ABSTRACT

A thermal recording sheet provided with a thermal color developing layer containing colorless or pale colored basic chromogenic dye, a color developer of Formula (I) and at least one of o-xylylene-bis-(phenylether) and 4-(m-methylphenoxymethyl) bisphenyl as a sensitizer.

Formula (I)

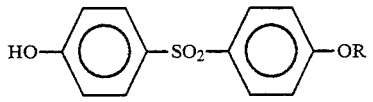

(I)

(wherein R is propyl, isopropyl, or butyl.)

6 Claims, No Drawings

THERMAL RECORDING SHEET

FIELD OF THE INVENTION

This invention relates to a thermal recording sheet which is superior in heat resistance, water resistance, and oil resistance.

DESCRIPTION OF THE PRIOR ART

In general, in thermal recording sheets, a normally colorless or pale colored basic chromogenic dye and an organic color developer such as a phenolic substance are individually pulverized into fine particles, mixed, and a binder, a filler, a sensitivity improver, a slip agent, and other additives are added to obtain a coating color, which is coated on a substrate such as paper, synthetic paper, films, plastics, and the like. The thermal recording sheet enables color recording by a momentary chemical reaction caused by heating with a thermal pen, a thermal head, a hot stamp, laser light, or the like.

These thermal recording sheets are applied in a variety of areas such as measurement recorders, computer terminal printers, facsimiles, automatic ticket vendors, and bar-code labels, however, with recent diversification and improvement of these recording devices, requirements to the thermal recording sheets have become stricter. For example, with increasing recording speed, it is required to obtain a high-concentration, sharp color image even with a small heat energy and, in addition, to have improved storage stability in terms of light resistance, weather resistance, and oil resistance.

Prior art examples of thermal recording sheets include, for example, thermal recording materials disclosed in Japanese Patent Publications 43-4160 and 45-14039, however, these prior art thermal recording materials have been defective, among others, in that the thermal response is low and a sufficient color developing density is not obtained in high-speed recording.

To improve such defects, high-sensitivity dyes such as using 3-N-methyl-N-cyclohexylamino-6-methyl-7-anilinofluorane (Japanese Patent Laid-open Publication 49-10912) and 3-dibutylamino-6-methyl-7-anilinofluorane (Japanese Patent Laid-open Publication 59-190891) have been developed, and technologies using 1,7-bis (hydroxyphenylthio)-3,5-dioxaheptane (Japanese Patent Laid-open Publication 59-106456), 1,5-bis (4-hydroxyphenylthio)-3-oxaheptane (Japanese Patent Laid-open Publication 59-116262), and 4-hydroxy-4'-isopropoxydiphenylsulfone (Japanese Patent Publication 63-46067) as color developers for higher speed and sensitivity have been disclosed.

OBJECT OF THE INVENTION

However, while these thermal recording sheets are high in sensitivity, they involve problems in heat resistance causing reduction in ground color when stored at high temperatures.

Furthermore, since the recording image is inferior in storage stability, disadvantages still remain in that water or oil components tend to adhere to the developed color image, and considerable reduction in image density or discoloration of the image occurs when contacting with plasticizers (DOP, DOA, etc.) contained in wrapping films such as PVC films.

Therefore, it is a primary object of the present invention to provide a thermal recording sheet which is high in sensitivity and superior in heat resistance, water resistance, and oil resistance.

SUMMARY OF THE INVENTION

In accordance with the present invention, there is provided a thermal recording sheet, characterized in that a specific diphenylsulfone derivative of Formula (I) as an organic color developer and at least one of o-xylylene-bis-(phenylether) and 4-(m-methylphenoxymethyl) biphenyl as a sensitizer are contained in a thermal color developing layer containing a basic dye, thereby solving all of the above problems:

Formula (I)

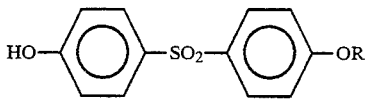

(I)

The basic colorless dye used in the present invention is a colorless or pale colored basic chromogenic dye (hereinafter simply referred to as a "basic colorless dye") and is not specifically limited, however, it is preferable to use triphenylmethane-type dyes, fluorane-type dyes, fluorene-type dyes, divinyl-type dyes, or the like, and practical examples of these dyes are shown below.

Triphenylmethane-type leuco dye 3,3-bis(p-dimethylaminophenyl)-6-dimethylaminophthalide [Crystal Violet Lactone]

Fluorane-type leuco dyes (I)

3-Diethylamino-6-methyl-7-anilinofluorane
3-(N-ethyl-p-toluidino)-6-methyl-7-anilinofluorane
3-(N-ethyl-N-isoamylamino)-6-methyl-7-anilinofluorane
3-Diethylamino-6-methyl-7-(o,p-dimethylanilino)fluorane
3-Pyrrolidino-6-methyl-7-anilinofluorane
3-Piperidino-6-methyl-7-anilinofluorane
3-(N-cyclohexyl-N-methylamino)-6-methyl-7-anilinofluorane
3-Diethylamino-7-(m-trifluoromethylanilino)fluorane
3-N-n-Dibutylamino-6-methyl-7-anilinofluorane
3-N-n-Dibutylamino-7-(o-chloroanilino)fluorane
3-(N-ethyl-N-tetrahdrofurfurylamino)6-methyl-7-anilinofluorane
3-Dibutylamino-6-methyl-7-(o,p-dimethylanilino)fluorane
3-(N-methyl-N-propylamino)-6-methyl-7-anilinofluorane
3-diethylamino-6-chloro-7-anilinofluorane
3-Dibutylamino-7-(o-chloroanilino)fluorane
3-Diethylamino-7-(o-chloroanilino)fluorane.
3-Diethylamino-6-methyl-chlorofluorane
3-Diethylamino-6-methyl-fluorane
3-Cyclohexylamino-6-chlorofluorane
3-Diethylamino-benzo[a]-fluorane
3-n-Dipentylamino-6-methyl-7-anilinofluorane
2-(4-Oxo-hexyl)-3-dimethylamino-6-methyl-7-anilinofluorane
2-(4-Oxo-hexyl)-3-diethylamino-6-methyl-7-anilinofluorane
2-(4-Oxo-hexyl)-3-dipropylamino-6-methyl-7-anilinofluorane Fluorene-type leuco dyes 3,6,6′-tris(dimethylamino)spiro[fluorene-9,3′-phthalide
3,6,6′-tris(diethylamino)spiro[fluorene-9,3′-phthalide Fluorane-type leuco dyes (II)

2-Methyl-6-p-(p-dimetylaminophenyl)aminoanilinofluorane
2-Methoxy-6-p-(p-dimethylaminophenyl)aminoanilinofluorane
2-Chloro-3-methyl-6-p-(p-dimethylaminophenyl-)aminoanilinofluorane
2-Chloro-6-p-(p-dimethylaminophenyl)aminoanilinofluorane
2-Nitro-6-p-(p-diethylaminophenyl)aminoanilinofluorane
2-Amino-6-p-(p-diethylaminophenyl)aminoanilinofluorane
2-Diethylamino-6-p-(p-diethylaminophenyl-)aminoanilinofluorane
2-Phenyl-6-methyl-6-p-(p-phenylaminophenyl-)aminoanilinofluorane
2-Benzyl-6-p-(p-phenylaminophenyl)aminoanilinofluorane
2-Hydroxy-6-p-(p-phenylaminophenyl)aminoanilinofluorane
3-Methyl-6-p-(p-dimethylaminophenyl)aminoanilinofluorane
3-Diethylamino-6-p-(p-diethylaminophenyl-)aminoanilinofluorane
3-Diethylamino-6-p-(p-dibutylaminophenyl-)aminoanilinofluorane Divinyl-type leuco dyes 3,3-Bis-[2-(p-dimethylaminophenyl)-2-(p-methoxyphenyl)-ethenyl]-4,5,6,7-tetrabromophthalide
3,3-Bis-[2-(p-dimethylaminophenyl)-2-(p-methoxyphenyl)-ethenyl]-4,5,6,7-tetrachlorophthalide
3,3-Bis-[1,1-bis(4-pyrrolidinophenyl)ethylene-2-yl]-4,5,6,7-tetrabromophthalide
3,3-Bis-[1-(4-methoxyphenyl)-1-(4-pyrrolidinophenyl)-ethylen-2-yl]-4,5,6,7-tetrachlorophthalide Others 1,1-Bis-[2′,2′,2″,2″-tetrakis-(p-dimethylaminophenyl)-ethenyl]-2,2-dinitrileethane
1,1-Bis-[2′,2′,2″,2″-tetrakis-(p-dimethylaminophenyl)-ethenyl]-2-β-naphthoylethane
1,1-Bis-[2′,2′,2″,2″-tetrakis-(p-dimethylaminophenyl)-ethenyl]-2,2-diacetylethane
Dimethyl-bis-[2′,2′,2″,2″-tetrakis-(p-dimethylaminophenyl)-ethenyl]-methylmalonate These dyes can be used alone or as mixtures of two or more.

The organic color developer may also be used in combination with known other color developers as much as the effect of the present invention is not impaired.

Furthermore, as a sensitizer, fatty acid amides such as stearamide, palmitamide, or the like; ethylene-bisamide, montan wax, polyethylene wax, dibenzyl terephthalate, benzyl p-benzyloxybenzoate, di-p-tolylcarbonate, p-benzylbiphenyl, phenyl-α-naphthylcarbonate, 1,4-diethoxynaphthalene, phenyl-1-hydroxy-2-naphthoate, 1,2-di-(3-methylphenoxy) ethane, di(methylbenzyl)oxalate, β-benzyloxynaphthalene, 4-biphenyl-p-tolylether, or the like can be added as much as the effect of the present invention is not impaired.

The binder used in the present invention can be completely-hydrolyzed polyvinylalcohol with a polymerization degree of 200 to 1,900, partially-hydrolyzed polyvinylalcohol, carboxy-modified polyvinylalcohol, amide-modified polyvinylalcohol, sulfonic acid-modified polyvinylalcohol, and other modified polyvinylalcohols, hydroxyethylcellulose, methylcellulose, carboxymethylcellulose, styrene-maleic anhydride copolymer, styrene-butadiene copolymer, cellulose derivatives such as ethylcellulose and acetylcellulose, polyvinylchloride, polyvinylacetate, polyacrylamide, polyacrylic esters, polyvinylbutyral, polystyrene and its copolymers, polyamide resins, silicone resins, petroleum resins, terpene resins, ketone resins, and coumarone resins. These polymeric substances can be dissolved in water, and solvents such as alcohols, ketones, esters, hydrocarbons, and the like, or emulsified or dispersed in water or other media, or can be used in combination according to the quality requirements.

In the present invention, it is also possible to add known stabilizers based on metal salts (Ca, Zn) of p-nitrobenzoic acid or metal salts (Ca, Zn) of monobenzylphthalate in amounts not to impair the effect of the present invention.

Fillers used in the present invention can be inorganic or organic fillers such as silica, calcium carbonate, kaolin, calcined kaolin, diatomaceous earth, talc, titanium oxide, aluminum hydroxide, or the like.

In addition to the above, it is possible to use release agents such as fatty acid metal salts, slip agents such as wax, benzophenone- or triazole-based ultraviolet absorbers, water resistant agents such as glyoxal, dispersants, defoamers, and the like.

The amounts of the organic color developer and the sensitizer used in the present invention and the types and amounts of other constituents are determined according to the required properties and recording adaptability, and are not specifically limited, but it is usually preferable to use 3 to 12 parts of the organic color developer, 3 to 12 parts of the sensitizer, and 1 to 20 parts of fillers to 1 part of the basic colorless dye, and the binder is used in an amount of 10 to 25% the total solid.

The solution of the above composition can be coated on any type of substrate such as paper, synthetic paper, films, plastics, or the like to obtain the objective thermal recording sheet.

Furthermore, the sheet can be provided on the thermal color developing layer with an overcoating layer of a polymeric substance or the like to improve the storage stability.

Furthermore, an undercoating layer containing an organic or inorganic filler can also be provided under the thermal color developing layer in order to improve the storage stability and sensitivity.

The organic color developer, the basic colorless dye, and the materials which are added as needed are pulverized by a pulverizing machine such as a ball mill, an attriter, a sand grinder, or the like, or by an appropriate emulsifying apparatus to a particle diameter of several microns or less, and mixed with the binder and various additives according to the purpose to obtain a coating color.

In the present invention, the reason why a combination of a specific stabilizer with a specific sensitizer gives the effect of the present invention is considered as follows.

First, the superior dynamic color developing ability is due to a high melt diffusion rate and a high saturation solubility of the sensitizer to the stabilizer of the present invention, thereby instantaneously forming a recording image by a momentary contact with a high-temperature thermal head.

The reason why the recording image is extremely high in stability in terms of water resistance and oil resistance is explained as follows. In general, a thermal recording paper uses a basic colorless dye as an electron donor, and an organic acid substance such as a phenolic compound, an aromatic carboxylic acid, an organic sulfonic acid, or the like as an electron acceptor. Heat melting reaction of the basic colorless dye and the color developer is an acid-base reaction based on electron donation and acceptance, which forms a metastable "charge transfer complex", thereby obtaining a color image.

When the specific diphenylsulfone derivative according to the present invention is used as an organic color developer, since the chemical bonding force between the diphenylsulfone derivative and the basic colorless dye in the color developing process is strengthened by the specific sensitizer of the present invention, the chemical bond is not ruptured even if the recording image is exposed to environmental conditions under which it is affected by water, oil, and the like for an extended period of time.

DESCRIPTION OF PREFERRED EMBODIMENTS

The present invention will now be described with reference to the examples and comparative examples. In the description, part means part by weight.

EXAMPLES 1–6

| | Part |
|---|---|
| Solution A (dye dispersion) | |
| 3-n-Dibutylamino-6-methyl-7-anilinofluorane | 2.0 |
| 10% aqueous polyvinylalcohol solution | 4.6 |
| Water | 2.5 |
| Solution B (color developer dispersion) | |
| Diphenylsulfone derivative (Table 1) | 6.0 |
| 10% aqueous polyvinylalcohol solution | 18.8 |
| Water | 11.2 |
| Solution C (sensitizer dispersion) | |
| Sensitizer (Table 1) | 4.0 |
| 10% aqueous polyvinylalcohol solution | 9.2 |
| Water | 5.0 |

The above solutions were individually ground by a sand grinder to an average particle diameter of 1 micron. Then, the dispersions were mixed in the following ratio to obtain a coating color.

| | |
|---|---|
| Solution A (dye dispersion) | 9.1 parts |
| Solution B (color developer dispersion) | 36.0 |
| Solution C (sensitizer dispersion) | 18.2 |
| Kaolin clay (50% dispersion) | 12.0 |

The above coating color was coated on one side of a 50 g/m$^2$ base paper to an amount of 6.0 g/m$^2$ and dried, and the sheet was treated by a super-calender to a flatness of 400–500 seconds to obtain a black-color developing thermal recording paper.

Comparative Examples 1–9

| | Part |
|---|---|
| Solution A (dye dispersion) | |
| 3-n-Dibutylamino-6-methyl-7-anilinofluorane | 2.0 |
| 10% aqueous polyvinylalcohol solution | 4.6 |
| Water | 2.5 |
| Solution B (color developer dispersion) | |
| Diphenylsulfone derivative (Table 1) | 6.0 |
| 10% aqueous polyvinylalcohol solution | 18.8 |
| Water | 11.2 |
| Solution D (sensitizer dispersion) | |
| Sensitizer (Table 1) | 4.0 |
| 10% aqueous polyvinylalcohol solution | 9.2 |
| Water | 5.0 |

The above solutions were individually ground by a sand grinder to an average particle diameter of 1 micron. Then, the dispersions were mixed in the following ratio to obtain a coating color.

| | |
|---|---|
| Solution A (dye dispersion) | 9.1 parts |
| Solution B (color developer dispersion) | 36.0 |
| Solution D (sensitizer dispersion) | 18.2 |
| Kaolin clay (50% dispersion) | 12.0 |

The above coating color was coated on one side of a 50 g/m$^2$ base paper to an amount of 6.0 g/m$^2$ and dried, and the sheet was treated by a super-calender to a flatness of 400–500 seconds to obtain a black-color developing thermal recording paper.

The thermal recording sheets obtained in the above Example and Comparative Examples were tested for quality and properties. The test results are shown in Table 1.

Note (1): Dynamic color developing density: Image density recorded using the Toshiba Thermal Facsimile KB-4800 at an applied voltage of 18.03 V and a pulse width 3.2 milliseconds is measured by a Macbeth densitometer (RD-914, an amber filter used).

Note (2): Heat resistance: Non-color developed sample is allowed to stand under a high-temperature dry condition at 60° C. for 24 hours, and the ground color density is measured by the Macbeth densitometer.

Note (3): Water resistance: Thermal paper sample dynamic-recorded by the method (1) is immersed in cold water at 20° C. for 24 hours, dried, and the recorded portion is measured by the Macbeth densitometer. The retention is calculated by the following equation.

Equation 1

$$\text{Retention (\%)} = \frac{\text{Image density after water treatment}}{\text{Density of untreated image}} \times 100\%$$

Note (4): Oil resistance: Image density recorded using the Toshiba Thermal Facsimile KB-4800 at an applied voltage of 18.03 V and a pulse width 3.2 milliseconds is measured by a Macbeth densitometer (RD-914, an amber filter used). The measured value is determined as an untreated image density. Salad oil is dropped onto the color developed portion, after 10 seconds, the oil is lightly wiped out by filter paper, allowed to stand at room temperature for 1 hour, and the image density is measured by the Macbeth densitometer. The retention is calculated by the following equation.

Equation 2

$$\text{Retention (\%)} = \frac{\text{Image density after oil treatment}}{\text{Density of untreated image}} \times 100\%$$

TABLE 1

Test Results

| Test No. | Color developer | Sensitizer |
|---|---|---|
| Example | | |
| 1 | 4-Hydroxy-4'-isopropoxydiphenylsulfone | o-Xylylene-bis-(phenylether) |
| 2 | 4-Hydroxy-4'-butoxydiphenylsulfone | Same as above |
| 3 | 4-Hydroxy-4'-n-propoxydiphenylsulfone | Same as above |
| 4 | 4-Hydroxy-4'-isopropoxydiphenylsulfone | 4-(m-methylphenoxymethyl) biphenyl |
| 5 | 4-Hydroxy-4'-butoxydiphenylsulfone | Same as above |
| 6 | 4-Hydroxy4'-n-propoxydiphenylsulfone | Same as above |
| Comp. Example | | |
| 1 | 4-Hydroxy-4'-isopropoxydiphenylsulfone | p-Benzylbiphenyl |
| 2 | Same as above | β-Benzyloxynaphthalene |
| 3 | Same as above | m-Terphenyl |
| 4 | 4-Hydroxy-4'-butoxydiphenylsulfone | Dibenzyloxalate |
| 5 | Same as above | Dibenzylterephthalate |
| 6 | Same as above | Di-p-tricarbonate |
| 7 | 4-Hydroxy-4'-n-propoxydiphenylsulfone | 1,4-Diethoxynaphthalene |
| 8 | Same as above | Benzyl-p-benzyloxybenzoate |
| 9 | Same as above | Stearamide |

| Test No. | Dynamic color developing density (1) | Heat resistance (2) | | Water resistance (3) | | | Oil resistance (4) | | |
|---|---|---|---|---|---|---|---|---|---|
| | | Un-treated | Treated | Un-treated | Treated | Retention (%) | Un-treated | Treated | Retention (%) |
| Example | | | | | | | | | |
| 1 | 1.28 | 0.05 | 0.07 | 1.28 | 1.16 | 91 | 1.29 | 1.18 | 92 |
| 2 | 1.29 | 0.05 | 0.08 | 1.29 | 1.20 | 93 | 1.29 | 1.20 | 93 |
| 3 | 1.30 | 0.05 | 0.08 | 1.30 | 1.19 | 92 | 1.30 | 1.18 | 91 |
| 4 | 1.31 | 0.05 | 0.07 | 1.31 | 1.19 | 91 | 1.31 | 1.18 | 90 |
| 5 | 1.30 | 0.05 | 0.07 | 1.30 | 1.21 | 93 | 1.30 | 1.20 | 92 |
| 6 | 1.32 | 0.05 | 0.07 | 1.32 | 1.19 | 90 | 1.32 | 1.19 | 90 |
| Comparative Example | | | | | | | | | |
| 1 | 1.24 | 0.06 | 0.11 | 1.24 | 0.88 | 71 | 1.24 | 0.85 | 69 |
| 2 | 1.20 | 0.06 | 0.10 | 1.20 | 0.89 | 74 | 1.20 | 0.82 | 68 |
| 3 | 1.22 | 0.06 | 0.12 | 1.22 | 0.87 | 71 | 1.22 | 0.80 | 66 |
| 4 | 1.23 | 0.06 | 0.15 | 1.23 | 0.88 | 72 | 1.23 | 0.84 | 68 |
| 5 | 1.05 | 0.05 | 0.13 | 1.05 | 0.88 | 84 | 1.05 | 0.81 | 77 |
| 6 | 1.23 | 0.06 | 0.12 | 1.23 | 0.87 | 71 | 1.23 | 0.81 | 66 |
| 7 | 1.22 | 0.06 | 0.15 | 1.22 | 0.80 | 66 | 1.22 | 0.82 | 67 |
| 8 | 1.05 | 0.06 | 0.11 | 1.05 | 0.71 | 68 | 1.05 | 0.81 | 77 |
| 9 | 1.00 | 0.06 | 0.12 | 1.00 | 0.65 | 65 | 1.00 | 0.83 | 83 |

The effects of the present invention are as follows:

(1) With superior heat response, a sharp, high-density image can be obtained even in high-speed, high-density recording (high sensitivity).

(2) Almost no discoloration occurs in the printed portion (color developed portion) even when contacts with plasticizers, salad oil, vinegar, and the like (oil resistance).

(3) Almost no discoloration occurs in the printed portion even when contacts with water (water resistance).

(4) Ground color is stable even at high temperatures (heat resistance).

What is claimed is:

1. A thermal recording sheet comprising a substrate and a thermal color developing layer on said substrate, said thermal color developing layer comprising a colorless or pale colored basic chromogenic dye, an organic color developer comprising a compound of Formula (I)

Formula (I)

(I)

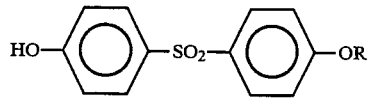

wherein R is propyl, isopropyl, or butyl and a sensitizer comprising o-xylylene-bis-(phenylether).

2. The thermal recording sheet of claim 1 wherein said thermal color developing layer comprises from 3 to 12 parts by weight of said organic color developer of Formula (I), and 3 to 12 parts by weight of said o-xylylene-bis-(phenylether) each per 1 part by weight of said colorless or pale colored basic chromogenic dye.

3. The thermal recording sheet of claim 1 further comprising an overcoating layer on said thermal color developing layer.

4. The thermal recording sheet of claim 1 further comprising an undercoating layer between said substrate and said thermal color developing layer.

5. The thermal recording sheet of claim 1 wherein the basic chromogenic dye is selected from the group consisting of triphenylmethane dyes, fluoran dyes, fluorene dyes, divinyl dyes and combinations thereof.

6. The thermal recording sheet of claim 1 wherein said thermal color developing layer further comprises from 1 to 20 parts of filler per part of basic colorless dye.

* * * * *